US005228586A

United States Patent [19]

Fuchs

[11] Patent Number: 5,228,586

[45] Date of Patent: Jul. 20, 1993

[54] MEDIA DISPENSER WITH REMOVABLE USE INDEX

[75] Inventor: Karl-Heinz Fuchs, Radolfzell, Fed. Rep. of Germany

[73] Assignee: Ing. Erich Pfeiffer GmbH & Co. KG, Fed. Rep. of Germany

[21] Appl. No.: 736,103

[22] Filed: Jul. 26, 1991

[30] Foreign Application Priority Data

Aug. 31, 1990 [DE] Fed. Rep. of Germany ..... 4027671

[51] Int. Cl.[5] ..... B67D 5/22

[52] U.S. Cl. ..... 222/38; 222/321

[58] Field of Search ..... 222/36, 38, 48, 49, 222/153, 321, 23; 239/333

[56] References Cited

U.S. PATENT DOCUMENTS

| | | | |
|---|---|---|---|
| 2,767,680 | 10/1956 | Lermer | 116/121 |
| 3,549,057 | 12/1970 | Perez | 222/249 |
| 3,678,884 | 7/1972 | Robbins | 116/121 |
| 3,796,348 | 3/1974 | Zipper | 222/38 |
| 3,802,608 | 4/1974 | Gullett | 222/309 |
| 4,376,495 | 3/1983 | Spatz | 222/46 |
| 4,565,302 | 1/1986 | Pfeiffer et al. | 222/38 |
| 4,667,845 | 5/1987 | Frazier et al. | 221/5 |
| 4,694,977 | 9/1987 | Graf et al. | 222/321 X |
| 4,705,182 | 11/1987 | Newel-Lewis | 222/23 X |
| 4,871,092 | 10/1989 | Maerte | 222/321 X |
| 4,944,430 | 7/1990 | Graf et al. | 222/321 |
| 4,961,508 | 10/1990 | Weimer et al. | 222/181 |

FOREIGN PATENT DOCUMENTS

| | | |
|---|---|---|
| 114617 | 8/1984 | European Pat. Off. . |
| 0114617 | 8/1984 | European Pat. Off. . |
| 269496 | 6/1988 | European Pat. Off. . |
| 1899374 | 1/1964 | Fed. Rep. of Germany . |
| 1227198 | 10/1966 | Fed. Rep. of Germany . |
| 459875 | 9/1968 | Fed. Rep. of Germany . |
| 1278077 | 9/1968 | Fed. Rep. of Germany . |
| 6603758 | 7/1969 | Fed. Rep. of Germany . |
| 2740298 | 3/1978 | Fed. Rep. of Germany . |
| 3335301 | 1/1985 | Fed. Rep. of Germany . |
| 8590143 | 5/1987 | Fed. Rep. of Germany . |
| 2411140 | 7/1979 | France . |
| 998765 | 7/1965 | United Kingdom . |

*Primary Examiner*—Andres Kashnikow
*Assistant Examiner*—Kenneth Bomberg
*Attorney, Agent, or Firm*—Quarles & Brady

[57] ABSTRACT

A discharge apparatus (1) has an indicator (37) indexable independently of the discharge actuating means (5) and which is solely formed by a single additional component, mounted by means of a snap connection (24) and in the form of a sleeve-like body (21), which carries a scale (40) behind a jacket of the actuating cap (19) rotatable in stepwise manner by means of a catch system (29) and provided with an indicating window (38).

32 Claims, 3 Drawing Sheets

MEDIA DISPENSER WITH REMOVABLE USE INDEX

BACKGROUND OF THE INVENTION

The invention relates to a dispenser for media, particularly for flowable media of a substantially random type, which are e.g. to be discharged from a medium reservoir in the form of discharge units by repeated manual actuation of a discharging means. Particularly for medical applications of such media it can be appropriate to have one or more determination or acquisition devices in the vicinity of or on the dispenser making it possible to determine, acquire or store such data and optionally render same visible from the outside as are of significance in conjunction with the use of the medium. Such data can e.g. be the number of already performed uses and/or at least the next-following use time, etc.

If the counting mechanism determines each pump stroke of the dispenser in such a way that one or more determining members are forcibly indexed in rotary manner, said determining member can be mounted on one or more bodies, which are simultaneously used for fixing the discharge pump to one or more bodies medium reservoirs or more.

SUMMARY OF THE INVENTION

An object of the invention is further to provide a discharge apparatus, which is improved compared with known constructions, particularly for certain applications which can be very easily constructed and/or fitted.

According to the invention, the body of the determination device is constructed as a separate component, which can also be fixed easily to the discharge unit if its discharging means is fixed to the medium reservoir not by a cap or a screw cap, but by a simpler fastening, which can e.g. be fixed by deformation or opened by destruction, such as e.g. by a crimp ring.

In place of a rotary mounting of the body on the preassembled discharge unit, there is appropriately a rigid mounting support either axially and/or in the rotation direction, the body in the manner of a holder forming a reinforcement of the relatively thin-walled fastening member for the connection of the discharging means to the medium reservoir. The body can also form a cover jacket for the complete protection of said fastening and optionally the constricted vessel neck and can be connected substantially continuously in elastically resilient manner to a shoulder of the vessel bulge of the medium reservoir, so that virtually no dirt gaps are formed. The outside diameter of the cover jacket can be at the most or approximately as large as the outside diameter of the vessel bulge, which gives a relatively uniform outer surface.

The body can also be directly constructed as a scale carrier for at least one scale, whose scale symbols are appropriately substantially uniformly distributed over the entire circumference. It is also conceivable to mount the body in relatively difficulty rotatable manner on the discharge unit, so tat it can be adjusted into different starting positions.

Moreover, to the body is advantageously connected a determining and/or indicating member in the manner of a freewheel, the locking engagement being such that on the one hand it is secured against unintentional rotation and on the other by applying a correspondingly high actuating force it can only be adjusted in one direction, whereas it is positively secured in the opposite direction. If said member is not formed by an adjusting structure mounted on the body, but instead is mounted axially and/or in rotary manner substantially independently of the body i a separate mounting support, it can be formed by an operating cap for operating the discharge means.

It is conceivable to so control the movable member of the determining device by a servodrive that during each discharge or after a certain number of discharges it is indexed. However, in additional thereto or in place thereof there can also be an adjustment by direct manual access completely independent of said discharge actuation, so that the determining member is only influenced by random adjustment.

The body can be easily fitted by substantially linear mounting or elastic resilient snapping on. If one of the two members of the determining device movable against one another is formed by the actuator of the discharge actuating means, then for arranging a counting mechanism only a single additional component is required, namely the body or scale carrier, which could optionally surround the actuator on the outer circumference and which would appropriately be provided with an indicating window or the like for rendering visible the scale provides on the actuator circumference. The reservoir is appropriately made from glass.

BRIEF DESCRIPTION OF THE DRAWINGS

These and other features can be gathered from the claims, description and drawings and, either singly, or in the form of random subcombinations, can be realized in an embodiment of the invention and in other fields and represent advantageous, independently protectable constructions for which protection is hereby claimed. An embodiment of the invention is described in greater detail hereinafter relative to the drawings, wherein:

DETAILED DESCRIPTION OF THE PREFERRED EMBODIMENTS

Figure 1:
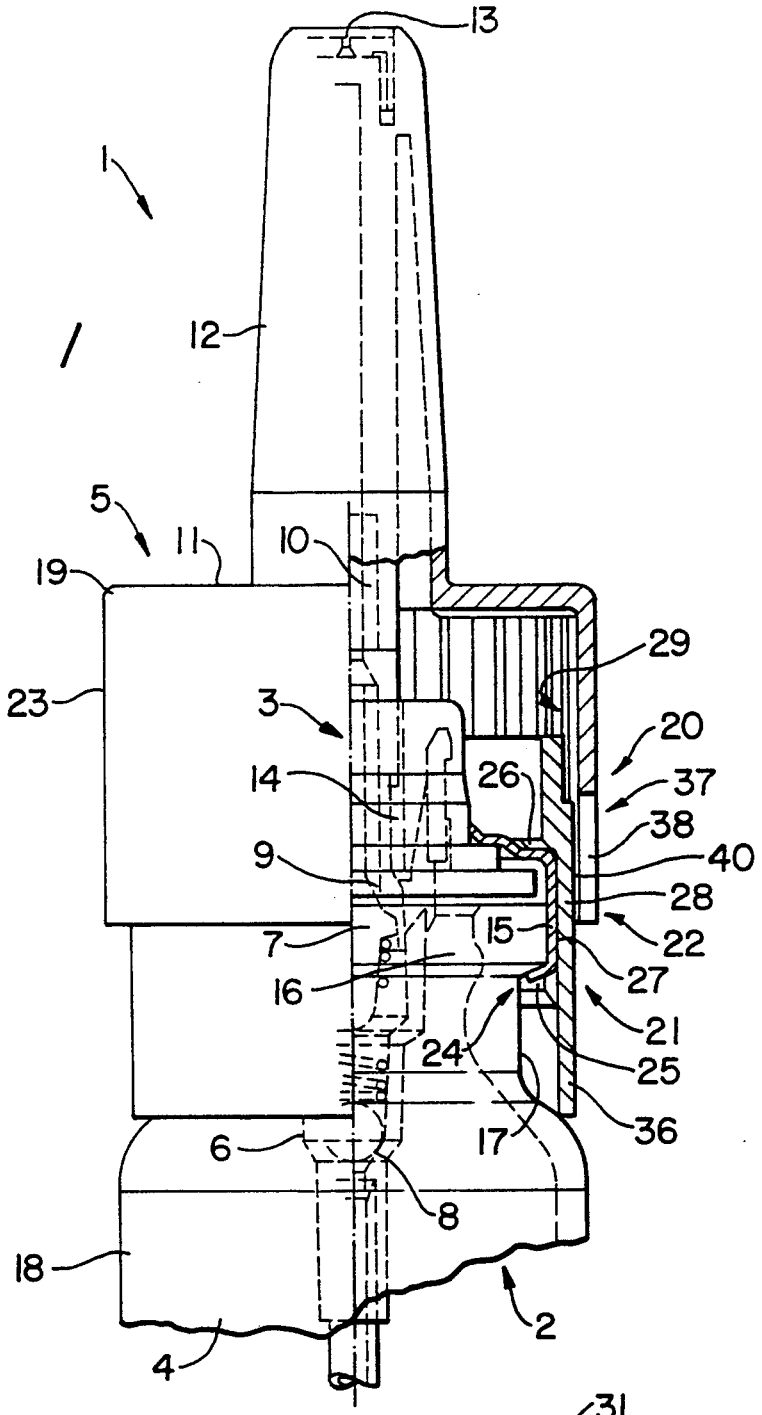
FIG. 1 shows an inventive discharge apparatus in a part sectional view.

The discharge apparatus 1 has a discharge unit 2 constructed as a closed subassembly with a discharging means 3 and a storage vessel 4, which are manually operated by a discharge actuating means 5 having an actuator 11. The piston unit 7 of a pump 6 largely engaging in the storage vessel 4 is operated and its pump chamber has a valve-controlled inlet 8 and a valve-controlled outlet 9. For operating purposes, a piston or operating rod 10 is provided, which is connected with a delivery handle in the form of the actuator 11 as a pressure surface surrounding it and is located by means of a plug-in connection on the piston rod of the piston unit 7. The operating rod 10 is traversed by an outlet channel connected to the outlet 9, is surrounded by a discharge connecting piece 12 constructed in one piece therewith and located roughly in the pump axis and has in the vicinity of its end face the discharge nozzle or opening 13 of the discharge unit 2 leading into the open. The cylinder casing forms with a cylinder cover a body 14 with which the discharging means 3 is fixed to the vessel neck 17 by a fastening member or fastening 15, e.g. a crimp ring engaging round a cap-like vessel flange 16. Between the vessel flange 16 and the vessel bulge 18 the vessel neck 17 forms on the outer circumference a circular groove and provides an inwardly directed end face at its junction with the vessel flange 16, which can be bounded on one side by the fastening 15. The part of the body projecting from the storage vessel 4 and the fastening 15 are engaged over by a cap 19, which forms with its end face the actuator 11 of the actuating means 5.

For determining, setting and indicating the next use time, a determining or memory device 20 is provided, which is essentially formed by a single additional component, namely a tubular or sleeve-like basic determining body 21, as well as a corresponding shaping of the plastic cap 19. The cap 19 can serve as an indicating or determining or memory member 22 rotatable in each lift position with respect to the body 21, the pump 6 and the storage vessel 4, and with which is associated the jacket or circumference 23 of the cap 19 as the actuator. Thus, this single component 19 forms with one end face an actuator 11 for the feed actuation and with a circumference an actuator 23 for the determining device 20. The necessary rotary forces are so selected that a rotation by a loading of the cap 19 in the rotary direction is not possible or is only possible with difficulty, so as to prevent an accidental operation of the determining device 20.

The sleeve body 21 is fixed with a snap connection 24 by merely engaging on the discharge unit 2 when the discharging means 3 and the storage vessel 4 have already been sealed and fixed to one another for use by the fastening 15. The latter is formed by a thin metal ring, whose end portions are so beaded over radially inwards and pretensioned against remote faces of the body 14 and the vessel flange 16 that the outer circumference of the latter engages in substantially whole-surface manner on the inner circumference of the jacket of the fastening 15. The snap connection 24 has cams 25 projecting in a ring over the inner circumference of the sleeve body 21 and which in the vicinity of the vessel neck 7 engage in axially pretensioned manner behind the rear or lower beaded over end portion of the fastening 15.

These cams 25 are located in the vicinity of a portion of the sleeve body 21, which can be so radially expanded under elastically recovering extension, that it automatically expands during the running up of the cams 25 during mounting on the associated face of the body 14 or the vessel flange 16 and then springs radially inwards in the fastening position. On the other, top surface of the fastening 15 engages a collar 26 projecting in one piece from the circumference of the sleeve body 21 and under the aforementioned axial pretension. The outer circumferential surface of the fastening 15 is in substantially whole-area engagement on the inner circumference of the sleeve body 21 under said radial pretension, which gives a relatively high frictional connection 27 to prevent rotation.

From its lower end and roughly up to the collar 26, the circumferential jacket 28 of the sleeve body 21 has constant external and internal cross-sections. Above the collar 26 a slightly greater jacket 28 thickness is provided, so that the bottom jacket portion is more elastic than the top portion. At least in the vicinity of the top jacket portion, the sleeve body 21 is connected to the cap 19 by axially displaceable engagement by an inner retaining guide or rotation preventing means 29.

To this end on the outer circumference of the sleeve body 21 are provided several uniformly circumferentially distributed, sawtooth-like locking cams 31 with which are associated a larger number of roughly axial locking grooves 32 uniformly distributed over the inner circumference of the jacket 35 of the cap 19. However, the jacket 35 is radially resiliently expandable to such an extent that the locking cams 31 with their shallowly rising back edges in one rotation direction can jump over the separating web between each two adjacent locking grooves 32, whereas the cams 31 are positively blocked against the other rotation direction by the engagement of their roughly radial front sides on the associated sides of the locking grooves 32. This forms a catch system with a catch spacing in which manual rotation in a single direction can occur without accidental retraction in the opposite direction.

To render visible the information to be represented by the determining device 20, an indicating device 37 is provided, which has as the indicator an indicating window 38 in the form of a jacket opening connected to the open bottom end of the jacket 35. At least in the starting position of the indicating window 38, behind it is located a symbol of a scale 40, which is provided on the outer circumference of the sleeve body 21 roughly in the center between its ends or in the vicinity of the fastening 15. The symbols of the scale 40 are uniformly distributed over the circumference in accordance with said catch spacing.

The cap 19 is engaged with the operating rod 10 on a piston shaft of the pump 6 roughly parallel to the central axis of the discharge apparatus or to the plugging direction of the body 21. Following the snapping on of the sleeve body 21, the cap 19 can also be engaged in such a way that its jacket 35 closely surrounds the sleeve body 21 roughly over half its length on the outer circumference in the starting position.

After removing the cap 19, it is also possible to replace by another sleeve body 21 and therefore the scale. The rear end portion 36 of the sleeve body 21 can substantially sealingly engage with its end edge face or its inner ring edge on the transition surface between the vessel neck 17 and the vessel bulge 18 with axial tension and consequently is slightly radially resiliently expanded by the conical transition surface, so that also in the case of a very thin-walled construction of the sleeve body 21 with a thickness of about 1 mm or less a high rigidity is ensured. The thickness of the sleeve jacket 28 can be the same order of magnitude as the thickness of the cap jacket 35.

The individual components or arrangements according to the subclaims can in each case be separately provided, i.e. also multiply or can be provided singly on one component. Thus, it is also possible to provide several mounting supports, scale carriers/scales, actuators, rotation prevention means, catch systems, etc. For example, the construction according to FIG. 3 can be combined with an embodiment at least similar to FIG. 1, so that there are at least two independently functioning determining means with a common body or separate bodies or determining members.

Figure 2:
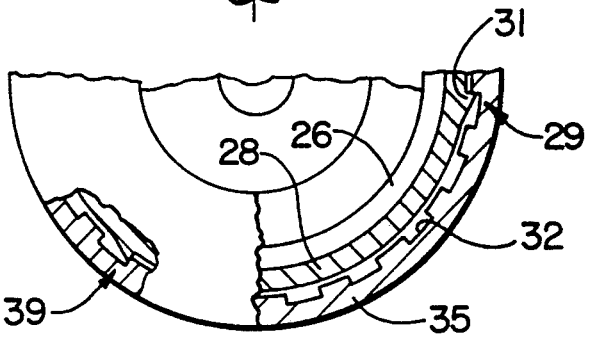
FIG. 2 shows a cross-sectional through the discharge apparatus of FIG. 1.
Figure 3:
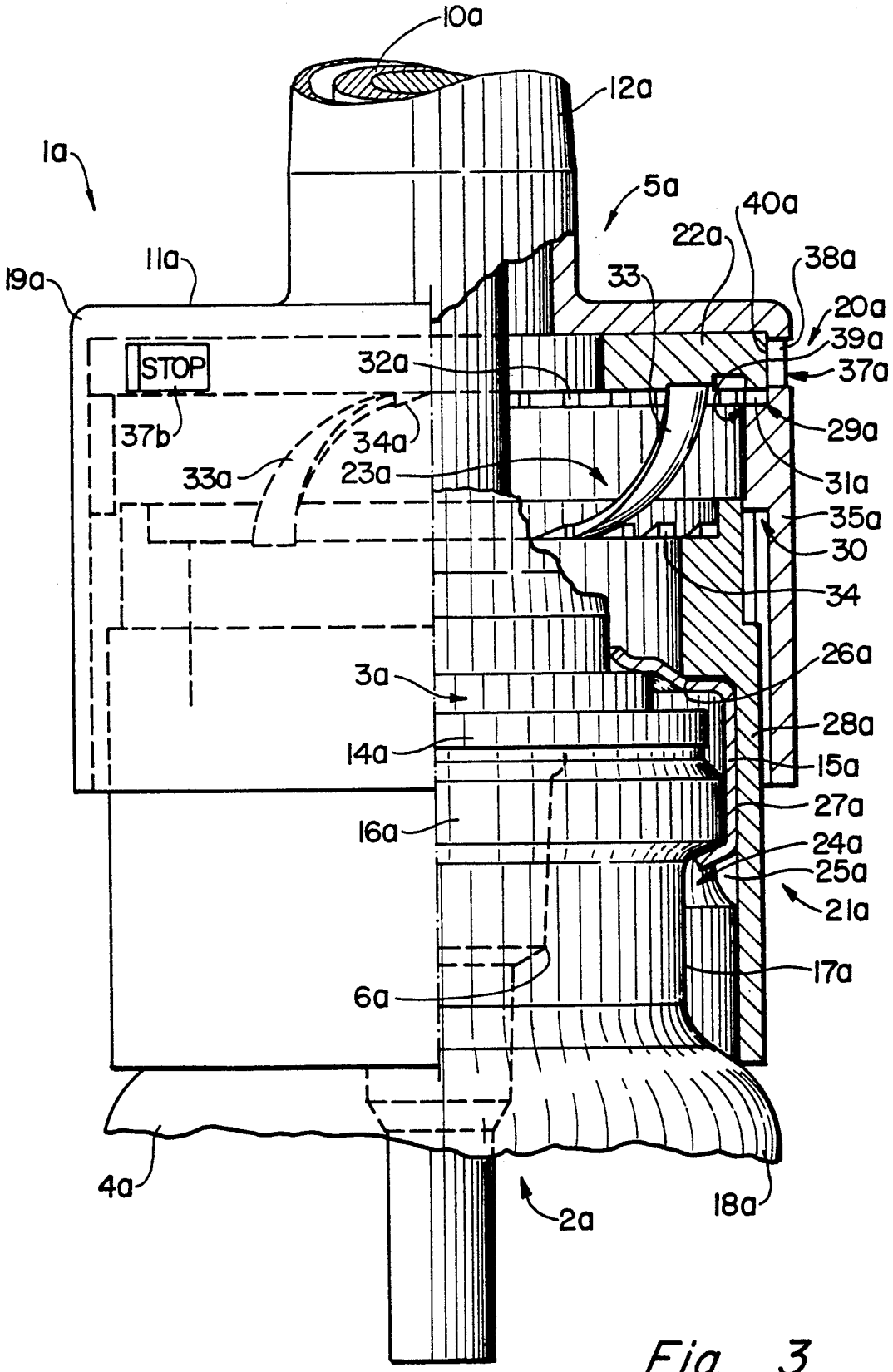
FIG. 3 shows a further embodiment in section.
Figure 4:
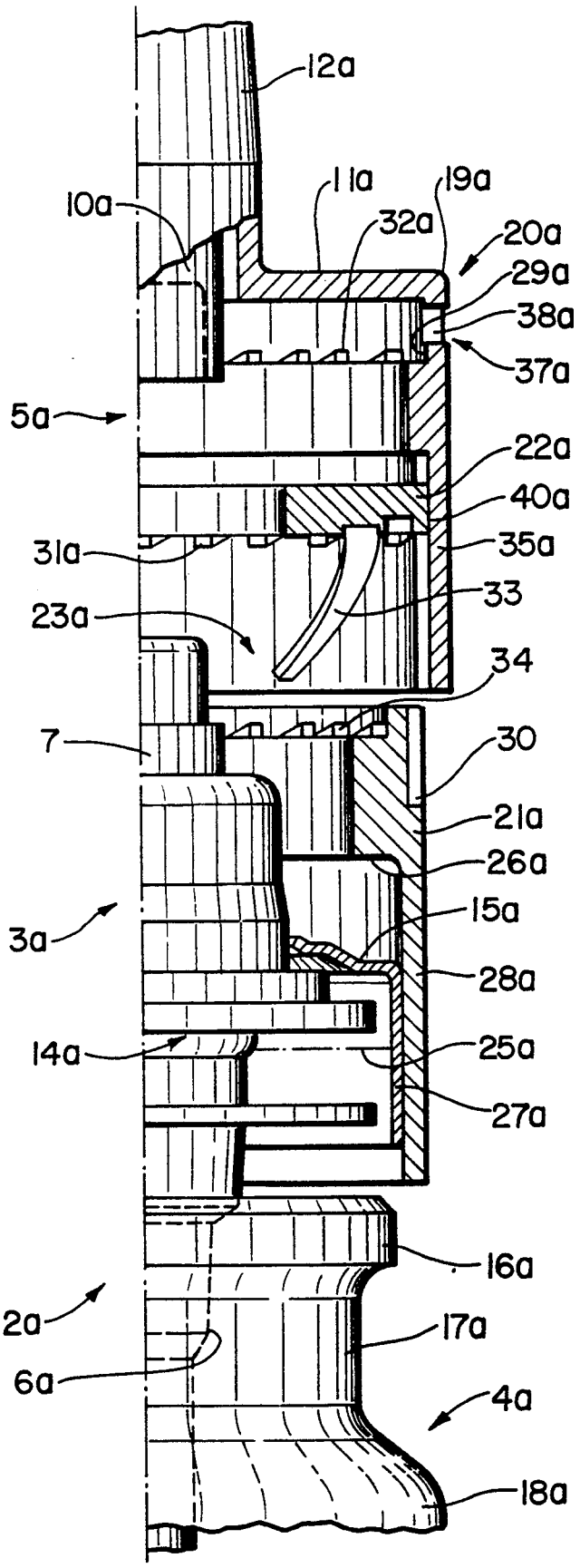
FIG. 4 shows a exploded sectional view according to FIG. 3.

FIG. 3 uses for corresponding parts the same reference numerals as in FIGS. 1 and 2, but followed by the letter a, so that all parts of the description correspondingly apply to both embodiments. The determining device **20*a* has a determining member 22*a* separate from the cap 19a, the actuator 11a and/or the jacket 35a of cap 19a, in the form of a stepping mechanism 23a, which is completely encapsulated with the cap 19a and has a radial spacing within the cap jacket 35a, so that during each operating stroke of the discharge actuator 11a of the discharge actuating means 5a, it is advanced or indexed by an operating step or a scale division. For this purpose the stepping mechanism 23a provides an operating arm 33 or 33a sloping with respect to the actuation direction and/or curved about the central axis of the stepping mechanism 23a substantially coinciding with the pump axis, and several operating arms 33 or 33a can be arranged in the form of one or more differently wide rings around the central axis. Each particular operating arm 33 or 33a is substantially fixed to either the determining member 22a or substantially fixed with respect to the body 21a so that it performs a pivoting movement about an axis at right angles to the central axis. Alternatively, the operating arm 33 or 33a which is bendable over its entire length can modify its inclined position by compression with respect to the central axis. One end of each arm 33 or 33a is fixed relative to either the determining member 22a or the body 21a, which can be achieved in simple manner by a one-part construction with said member. The other free end of the arm 33 or 33a is located in the vicinity of a ring of a tooth system 34 or 34a with sawtooth-like teeth and forms with said ring a freewheel-like locking mechanism, so that said free end can only be rotated in one direction about the central axis from said locking position with respect to the tooth system 34 or 34a**.

As a flatter operating ring compared with its external diameter, the determining member 22a is axially secured in both directions in the cap 19a, e.g. by being mounted on the inner circumference of the jacket 35a and axially supported on the inner face of the end wall forming the actuator 11a. In the lower axial direction, the determining member 22a can be secured by a projection on the inner circumference of the jacket 35a by a ringlike snap cam, so that the determining member 22a is led past said snap cam, accompanied by an elastic widening of the jacket 35a and can be fitted from the cap opening by springing in. In the inoperative or starting position of the discharge apparatus 1a the determining member 22a is in a larger axial spacing from the face of the sleeve body 21a facing it than at the end of the pump stroke. The tooth system 34 or 34a can be so countersunk in the face of the sleeve body 21a or the determining member 22a, respectively, in the vicinity of a ring shoulder, that when the determining member 22a strikes against the sleeve body 21a in the pump stroke end position the operating arm 33 or 33a, is stretched and located in jamming-free manner within said countersink. If the two ends of the operating arm 33 or 33a, like the determining member 22a and the body 21a, are axially approached to one another during the pump stroke, then the slope of the operating arm 33 or 33a decreases and the circumferential distance of its ends increase by an amount which is at least twice as large as the single or integral multiple of the division of the teeth 34 or 34a, so that the determining member 22a is further rotated by a step corresponding with this amount. During the return stroke for the pump piston caused by the return spring located within the pump 2a, the ends of the operating arm 33 or 33a are axially moved apart, so that its slope increases. The determining member 22a is secured by a freewheel-like locking member 29a against rotation counter to its indexing or operating rotation direction, so that the free end of the operating arm 33 or 33a slopes over the sloping back faces of the teeth 34 or 34a until it again jumps in front of a locking tooth face and is therefore in the starting position of the next operating or indexing step.

The locking mechanism 29a acts between the determining member 22a and the cap 19a and can be provided in the vicinity of a circumferential surface and/or at least one end face of the determining member 22a. In place of the locking mechanism 29a in the vicinity of the inside of the end wall of the cap 19a and roughly between the outer circumference of the actuating rod 10a and the inner circumference of the outer jacket of the discharge connection 12a, it can be appropriate to position it on the other end of the determining member 22a and it appropriately extends up to the outer circumference of the member 22a. Instead of a locking mechanism 29a acting only frictionally or by a correspondingly high friction, it is also appropriate to provide a catch mechanism 39a which, as described relative to the locking teeth 34 or 34a, has in a ring a tooth system 32a, in which engage two or more circumferentially distributed locking cams 31a, which can jump over in one rotation direction and which appropriately project from the associated face of the determining member 22a and can extend radially up to its outer circumference and/or are provided in the snap cam for the determining member 22a or are formed by the same.

In this embodiment the mounting support for the determining member 22a formed by the cap 19a is appropriately prevented from rotation in each lift position with respect to the body 21a and a rotatability according to FIG. 1 can be provided in at least one end position. The rotation preventing means 30 has cams engaging in longitudinal grooves or splines, which project appropriately in one piece over the inner circumference of the jacket 35a and engage in axial grooves on the outer circumference of an end portion of the sleeve body 21a, whose outside diameter is slightly reduced. These cams can simultaneously form the snap cams for the determining member 22a or the tooth system or locking cams of the catch mechanism 39a and are spaced from the open end of the cap 19a.

Due to the fact that the sleeve body 21a can be fitted independently of the pump 2a or only following the installation thereof on the storage vessel 4a, the sleeve body 21a with its jacket 28a and the cap 19a can be relatively easily manually rotatably mounted about the central axis with respect to the pump 2a or the storage vessel 4a on the fastener 15a, without the reading of the determining device 20a being changed, so that the reading or display can always be brought into the most favorable viewing position. The sleeve body 21a is supported by an inner ring shoulder 26a remote from the tooth system 34 or 34a and which for obtaining a compact axial extension of the determining device is located within the jacket 35a located in the starting position on a circular face of the crimping ring forming the fastening 15a and which is directed towards the actuator surface 11a of the actuating means 5. The face extending up to the outer circumference of the crimping ring is formed by a portion of the latter, which is substantially contact-free on the inside and is therefore slightly elastically resilient, so that as a result of this support and that of the snap connection 24a or the cam 25a, it is possible to obtain a substantially axial clearance-free mounting of the sleeve body 21a. A contribution to this can also be made by the axial returning spring action of the operating arm 33 or 33*a*, which not only supports the return spring of the pump 2*a* during the return stroke, but also axially presses apart the determining member 22 and the sleeve body 21*a*, so that the determining member 22*a* is resiliently pressed against the face of the cap 19*a* and the sleeve body 21*a* with its inner ring shoulder 26*a*. The snap cam 25*a* can also pass in circularly interrupted manner over the inner circumference of the sleeve jacket 28*a*. Between the ring shoulder 26*a* and the teeth 34*a* and/or in the vicinity thereof the inner circumference of the sleeve body 21*a* can be centered with respect to the outer circumference of the casing of the pump 2*a* or the actuating rod 10*a* as a result of a corresponding narrow construction and consequently the stability against transverse forces is increased.

In this case, the scale 40 is located on the outer circumference of the determining member 22*a*. It is in the vicinity of a display window 38*a* of the display means 37*a* transversing the jacket 35*a* adjacent to the inside of the end wall of the cap 19*a*. Circumferentially and spaced from the display means 37*a* there is appropriately a further display means 37*b*, which e.g. dipslays the first and/or last actuating stroke of a predetermined total number of strokes, which can be performed with the discharge apparatus 1*a*. At the end of the final actuating stroke, the actuator 11*a* and/or the determining member 22*a* can be blocked against further operating movements, e.g. by a cam on the determining member 22*a*, which runs against a counterstop of the cap 19*a* and consequently indirectly locks against the actuating stroke via the operating arms 33, 33*a*.

Instead of the appropriately flat, strip-like operating arms 33, 33*a* being connected to the associated end face of the determining member 22*a* at a distance from the inner and/or outer circumference, they can be so connected to the determining member 22*a* in the vicinity of one of said circumferences, so that they are associated with one end of the tooth system 34 or 34*a* and form with the other end a locking cam for the catch mechanism. However, more favorable leverage is obtained if the operating arms 33, 33*a* are relatively close to the inner circumference of the cap jacket 35*a*. The predetermined total number of operating steps of the determining member 22*a* appropriately gives a rotation angle or less than 360° or 180° or even less than 90°, so that if the arms 33, 33*a* are articulated both to the determining member 22*a* and to the sleeve body 21*a*, respectively, no measures have to be taken to ensure that said arms move past or over one another, because at the start of the first actuating stroke they are angularly spaced and said angle is larger than the maxim rotation angle.

As the determining device 20*a* or the sleeve body 21*a* and/or the cap 19*a*, including the determining member 22*a*, can be released or replaced in non-destructive manner with respect to the remaining discharge apparatus merely by drawing off, it is easy to dispose of these components at the end of use of the discharge apparatus 1*a*, all the parts appropriately being made from plastic or substantially identical material.

I claim:

1. A dispenser for discharging media from a reservoir, comprising:

discharge actuating means;

a discharge unit, manually operable by said discharge actuating means for expelling media from the reservoir;

fastening means for fastening said discharge unit on the reservoir; and a memory device controllable by means of a memory device actuator connected to said discharge actuator means, said memory device including a basic determining body for bearingly mounting said memory device with respect to the reservoir, wherein said basic determining body of said memory device is separate from said fastening means, whereby expulsion of media can occur with and without the basic determining body being mounted, and wherein said basic determining body of said memory device is prevented from rotation with respect to at least part of said discharge unit during actuation.

2. The dispenser according to claim 1, wherein said basic determining body of said memory device is provided with a snap connection for positional securing on said reservoir.

3. The dispenser according to claim 1, wherein said basic determining body engages an end face of said fastener.

4. The dispenser according to claim 1, wherein said basic determining body provides a partial external cover for at least one of:

a vessel neck of the reservoir, said fastening means, and a portion of said discharge unit projecting past said fastening means, said basic determining body having a length and providing a substantially closed cover over said length.

5. The dispenser according to claim 1, wherein said basic determining body projects substantially freely beyond a top end face of said fastening means.

6. The dispenser according to claim 1, wherein the reservoir has an external transition surface between a vessel neck and a wider vessel bulge, said basic determining body being extendable substantially to said transition surface.

7. The dispenser according to claim 1, wherein said basic determining body provides an enveloping holder for said fastening means, said holder engaging at least partly with pretension on at least one of faces defined by an outer circumference and an end face of said fastening means.

8. The dispenser according to claim 1, wherein said fastening means is a crimp ring.

9. The dispenser according to claim 1, wherein said basic determining body defines an overall length extension and is provided by a sleeve having substantially constant inside and outside width extensions over said length extension.

10. The dispenser according to claim 1, wherein said basic determining body provides a collar projecting from an inner circumference of said sleeve body for engaging an outwardly facing end face of the reservoir and said basic determining body provides at least one snap cam for engaging an inwardly directed end face of the reservoir.

11. The dispenser according to claim 1, wherein said basic determining body provides a mounting section for supportingly engaging said discharge unit, said basic determining body being resiliently expandable at least in the vicinity of said mounting section.

12. The dispenser according to claim 1, wherein said basic determining body provides a scale carrier.

13. The dispenser according to claim 1, wherein said basic determining body is constructed in one piece with a scale carrier.

14. The dispenser according to claim 1, wherein said basic determining body is provided with at least one scale on an outer circumference.

15. The dispenser according to claim 1, wherein said basic determining body is dispensed inside a cap jacket surrounding and movable with respect to said basic determining body.

16. The dispenser according to claim 15, wherein said jacket is provided by a cap-like actuator of said discharge actuating means displaceably mounted for operationally performing a rotation and an axial stroke motion.

17. The dispenser according to claim 15, wherein said jacket is at least partly guided in a mounting support independent of said basic determining body.

18. The dispenser according to claim 1, wherein said memory device has an indicator window adjustable with respect to a scale, said indicator window being provided on a jacket at least partly surrounding said basic determining body and provided by said discharge actuating means.

19. The dispenser according to claim 1, wherein said memory device is operationally movable with at least one of characteristics defined by:

a step wise locked motion; and a rotational motion in only one direction, said memory device engaging said basic determining body via a freewheel ratchet.

20. The dispenser according to claim 1, wherein said memory device is operationally movable to a number of memory positions, said memory devices being operable by substantially direct manual rotation of said memory device actuator.

21. The dispenser according to claim 1, wherein said memory device is operable via a stepwise actuating mechanism as a function of a media discharging operation of said discharge actuating means.

22. The dispenser according to claim 1, wherein a drive mechanism is provided for driving said memory device including an operating arm pivotably engaging a drive serration in said basic determining body.

23. The dispenser according to claim 1, wherein said memory device provides a memory member defining a switching ring located between said basic determining body and a facing internal end face of said discharge actuating means.

24. The dispenser according to claim 1, wherein said memory device provides a memory member mounted in axially substantially stable position inside said discharge actuating means.

25. The dispenser according to claim 1, wherein said memory device provides a memory member operationally displaceable to switching positions, said memory member being positionally secured with respect to an actuator of said discharge actuating means by a locking mechanism in substantially each of said switching positions.

26. The dispenser according to claim 1, wherein said memory device provides a memory member, means being provided for positionally but releasably holding said memory member in substantially any position of a number of rotational positions and for releasably overcoming at least one respective one of said positions as a function of an operating force.

27. The dispenser according to claim 26, wherein said holding means provide a rotation preventing means for preventing free rotation of said memory member, said rotation preventing means including circumferentially distributed, axial locking grooves on an inner circumference of said memory member and locking cams projecting on an outer circumference of said basic determining body.

28. The dispenser according to claim 1, wherein said discharge actuating means includes a discharge actuator and said memory device includes a second actuator, means being provided for transferring said dispenser to at least one of states defined by:

a state with said discharge actuator of said discharge actuating means removed from said discharge unit;

a state with said second actuator of said memory device removed from said memory device; and a state with said discharge unit assembled with said reservoir, mounting means being provided for mounting said basic determining body on said dispenser in at least one of said states.

29. The dispenser according to claim 28, wherein said actuator is connectable via a plug connection to at least one of units defined by said discharge and said basic sleeve body.

30. The dispenser according to claim 1, wherein said memory device is exclusively provided by two components, one of said components being formed by said discharge actuating means.

31. A dispenser for discharging media from a reservoir, comprising:

discharge actuating means;

a discharge unit, manually operable by said discharge actuating means for expelling media from the reservoir;

fastening means for fastening said discharge unit on the reservoir; and a memory device controllable by means of a memory device actuator connected to said discharge actuator means, said memory device including a basic determining body for bearingly mounting said memory device with respect to the reservoir, wherein said basic determining body of said memory device is separable from said fastening means and said basic determining body is prevented from rotation with respect to at least part of said discharge unit substantially exclusively by frictional engagement.

32. The dispenser according to claim 1, wherein said at least one basic determining body of said memory device has at least one of mounting means defined by:

a mounting surface for plugging onto said fastening means;

a mounting surface that is prevented from rotation during actuation but can be rotated by sufficient manual torque;

a mounting surface which is oriented coaxially with said discharge unit; and a mounting member for engaging an outer circumference of said fastener, said at least one mounting means being provided for mounting said memory device on said discharge unit.

* * * * *